US008545269B2

(12) United States Patent
Ore-Yang

(10) Patent No.: US 8,545,269 B2
(45) Date of Patent: Oct. 1, 2013

(54) USB WIRELESS CONNECTION PORT FOR KEYBOARD, MOUSE AND PRESENTER

(75) Inventor: Steve Ore-Yang, Taipei (TW)

(73) Assignee: Acrox Technology Corporation Ltd., Taipei (TW)

( * ) Notice: Subject to any disclaimer, the term of this patent is extended or adjusted under 35 U.S.C. 154(b) by 163 days.

(21) Appl. No.: 12/986,659

(22) Filed: Jan. 7, 2011

(65) Prior Publication Data

US 2012/0040561 A1 Feb. 16, 2012

(30) Foreign Application Priority Data

Aug. 13, 2010 (TW) ..... 099215674 U

(51) Int. Cl.
*H01R 13/66* (2006.01)

(52) U.S. Cl.
USPC ..... 439/620.22; 439/76.1; 439/660

(58) Field of Classification Search
USPC ..... 439/620.22, 76.1, 660
See application file for complete search history.

(56) References Cited

U.S. PATENT DOCUMENTS

| | | | | |
|---|---|---|---|---|
| 7,909,654 | B2 * | 3/2011 | He et al. | 439/660 |
| 7,946,857 | B2 * | 5/2011 | Wang | 439/76.1 |
| 8,226,445 | B2 * | 7/2012 | Garnier | 439/660 |
| 2004/0033726 | A1 * | 2/2004 | Kao | 439/660 |
| 2005/0042930 | A1 * | 2/2005 | Harkabi et al. | 439/660 |
| 2010/0267285 | A1 * | 10/2010 | Wang | 439/660 |
| 2011/0199729 | A1 * | 8/2011 | Hsieh | 361/679.33 |
| 2012/0071022 | A1 * | 3/2012 | Su et al. | 439/449 |
| 2012/0196483 | A1 * | 8/2012 | Kuster | 439/626 |

FOREIGN PATENT DOCUMENTS

| | | |
|---|---|---|
| TW | M249297 | 11/2004 |
| TW | I288315 | 10/2007 |

* cited by examiner

*Primary Examiner* — Hae Moon Hyeon
(74) *Attorney, Agent, or Firm* — Volpe and Koenig, P.C.

(57) ABSTRACT

A USB wireless connection port for a keyboard, a mouse and a presenter is provided. The USB wireless connection port includes a metal frame; a circuit board disposed inside the metal frame and having an upper face and a lower face, wherein the upper face has a plurality of terminals disposed thereon and the lower face has an electronic element disposed thereon; and a wireless module electrically connected to the terminals, wherein the metal frame has a first hollow area above the upper surface of the circuit board, and the electronic element is selected from a group consisting of a microcomputer chip, a microprocessor and the wireless module.

11 Claims, 5 Drawing Sheets

USB WIRELESS CONNECTION PORT FOR KEYBOARD, MOUSE AND PRESENTER

FIELD OF THE INVENTION

The present invention relates to a connection port, and more particularly to a universal serial bus (USB) wireless connection port for use in a keyboard, a mouse or a presenter.

BACKGROUND OF THE INVENTION

Please refer to FIG. 1, which shows a conventional USB plug in use, i.e. the technology disclosed in the Taiwan Patent No. M249297. FIG. 1 shows that a USB plug 2 is inserted into a USB socket 1. The USB socket 1 includes a case 10 and a tongue piece 12 disposed in the case 10. When the USB plug 2 is inserted into the USB socket 1, the tongue piece 12 and the USB plug 2 are mutually connected via their respective inner terminals (not shown). FIG. 1 shows that the USB plug 2 is successfully inserted into the USB socket 1 and the electrical connection therebetween is actuated, wherein a top 2T of the USB plug 2 urges against the tongue piece 12, a bottom 2B of the USB plug 2 urges against the case 10, and two sides of the top 2T of the USB plug 2 respectively extend upward to form two guiding plates 21. When the USB plug 2 is inserted into the USB socket 1, the guiding plates 21 are located in the gaps between the tongue piece 12 and the case 10. The feature of the mentioned patent is to remove the case of the conventional USB plug to reduce the overall thickness thereof, thereby achieving the thinning effect. Besides, if the USB plug 2 is inserted into the USB socket 1 upside down, the guiding plates 21 will interfere with the case 10, which disables the USB plug 2 from being inserted into the USB socket 1. However, in practice, since the case of the USB plug 2 is made of plastics, it will be worn out after many times of use, especially the bottom 2B of the USB plug 2. Therefore, the thickness of the USB plug 2 will be thinner and thinner after many times of use. Besides, since the guiding plates 21 are protrusive, they not only are easy to collide with the case 10 and the tongue piece 12 of the USB socket 1 during the insertion, but also are easy to collide with other objects when not used. Moreover, since the case of the USB plug 2 is made of plastics, it will be easier to be deformed, broken or worn out during collision. Based on the above, the height of the guiding plates 21 of the USB plug 2 will be lowered and the bottom 2B of the USB plug 2 will be worn out after many times of use. This makes the overall thickness of the USB plug 2 thinner. That is, the thinned USB plug 2 will be easier to be inserted into the USB socket 1 upside down, i.e. the erroneous insertion will occur, and the foolproof effect is inactive. Additionally, even if the USB plug 2 is not worn out, the size of the USB socket 1 will change after many times of insertion and pull, especially the tongue piece 12. Since the tongue piece 12 is only a circuit board rather than an element with a high mechanical strength, it may slant upward after many times of insertion and pull. That is, the upper edge of the tongue piece 12 will be closer to the case 10, and relatively the lower edge of the tongue piece 12 will be farther from the case 10. This enlarges the space for containing the USB plug 2, which may enable the USB plug 2 to be inserted into the USB socket 1 upside down, and the foolproof effect is inactive. That is why the conventional USB plug 2 of FIG. 1 does not use the metal material. Due to the thinning design, element deformation and size change, the chance of inserting the USB plug 2 into the USB socket 1 upside down is greatly increased. Once the USB plug with a metal case is inserted into the USB socket 1 upside down, it will be electrically connected to the terminal in the tongue piece 12 to cause a short circuit. Hence, it is necessary to use the plastics, which are bad conductors, to manufacture the case of the USB plug 2. However, the above-mentioned issues will be generated by using the plastic case. Therefore, the conventional USB plug 2 of FIG. 1 is not practical.

Please refer to FIG. 2, which shows another conventional USB plug, i.e. the technology disclosed in the Taiwan Patent No. 1288315. The USB plug 2' includes a case 2'*a*, and a supporting board 2'*b* is disposed in the case 2'*a*. A plurality of terminals 2'*b*1 are disposed on the supporting board 2'*b*, and a connecting mezzanine 2's is formed between the supporting board 2'*b* and the case 2'*a*. Based on the above, the USB plug 2' is a quite common USB plug. However, the USB plug 2' further has a plurality of electronic elements 2'*c* disposed at the lower face of the supporting board 2'*b* for sufficiently utilizing the space.

However, the disadvantage of the USB plug 2' of FIG. 2 is that it uses the case 2'*a* which entirely covers the supporting board 2'*b*. Accordingly, when the supporting board 2'*b* is installed into the case 2'*a*, it cannot be inspected anymore. In this situation, it is impossible to determine whether the terminals 2'*b*1 on the supporting board 2'*b* are deficient or rusty, or the supporting board 2'*b* is slanting. Similarly, it is impossible to inspect whether the electronic elements 2'*c* at the lower face of the supporting board 2'*b* have defects. Therefore, the conventional USB plug 2' of FIG. 2 has the disadvantage of low yield rate, which is a potential crisis for the credit of the company.

In order to overcome the drawbacks in the prior art, a USB wireless connection port is provided. The particular design in the present invention not only solves the problems described above, but also is easy to be implemented. Thus, the present invention has the utility for the industry.

SUMMARY OF THE INVENTION

The objects of the present invention are to save materials during the manufacturing process of the USB wireless connection port, and to observe whether the positions of elements are correct or the elements have defects during the quality control. Besides, when using the USB wireless connection port of the present invention, the user can easily identify the front and reverse sides thereof. This can save time and prevent the USB wireless connection port from damage.

In accordance with one aspect of the present invention, a USB wireless connection port for a keyboard, a mouse and a presenter is provided. The USB wireless connection port comprises a plug body, including a pair of lateral boards made of metal; an upper board; and a lower board made of metal; a circuit board disposed inside the plug body and having an upper face and a lower face, wherein the USB wireless connection port has a distance between the circuit board and the upper board greater than that between the circuit board and the upper board; a power terminal disposed at the upper face of the circuit board, wherein the upper board has a hollow area exposing the power terminal; a ground terminal disposed at the upper face of the circuit board, wherein the hollow area exposes the ground terminal; a signal output terminal disposed at the upper face of the circuit board, wherein the hollow area exposes the signal output terminal; a signal input terminal disposed at the upper face of the circuit board, wherein the hollow area exposes the signal input terminal; and an electronic element disposed at the lower face of the circuit board and including a wireless module for receiving and sending a wireless signal.

Preferably, the USB wireless connection port further comprises a microcomputer chip electrically connected to the power terminal, the ground terminal, the signal output terminal and the signal input terminal.

Preferably, the USB wireless connection port further comprises a microprocessor electrically connected to the power terminal, the ground terminal, the signal output terminal and the signal input terminal.

Preferably, the USB wireless connection port is a mini-USB connection port.

In accordance with another aspect of the present invention, a USB wireless connection port for a keyboard, a mouse and a presenter is provided. The USB wireless connection port comprises a pair of metal lateral boards, forming a first opening and a second opening therebetween; a circuit board disposed at the second opening, and having a first face and a second face; a plurality of terminals disposed at the first face of the circuit board and facing the first opening; a wireless module electrically connected to the terminals; and an electronic element having at least a portion disposed at the second face of the circuit board, and being one of a microcomputer and a microprocessor.

Preferably, the USB wireless connection port further comprises a beam disposed between the metal lateral boards.

Preferably, the terminals comprise a power terminal, a ground terminal, a signal output terminal and a signal input terminal.

Preferably, the second opening is filled with a resin for covering a portion of the electronic element.

In accordance with a further aspect of the present invention, a USB wireless connection port for a keyboard, a mouse and a presenter is provided. The USB wireless connection port comprises a metal frame; a circuit board disposed inside the metal frame and having an upper face and a lower face, wherein the upper face has a plurality of terminals disposed thereon and the lower face has an electronic element disposed thereon; and a wireless module electrically connected to the terminals, wherein the metal frame has a first hollow area above the upper surface of the circuit board, and the electronic element is selected from a group consisting of a microcomputer chip, a microprocessor and the wireless module.

Preferably, the metal frame has a second hollow area below the lower face.

Preferably, the USB wireless connection port further comprises a protection layer covering the electronic element.

In accordance with further another aspect of the present invention, a USB wireless connection port for a keyboard, a mouse and a presenter is provided. The USB wireless connection port comprises a case body having a bottom and at least a wall; a circuit board disposed inside the case body and near the bottom of the case body, and having an upper face and a lower face, wherein the upper face has a terminal disposed thereon, and the lower face faces the bottom of the case body; and a wireless module electrically connected to the terminal and having a portion extending to the lower face.

Preferably, the USB wireless connection port further comprises an electronic element electrically connected to the terminal, being one of a microcomputer chip and a microprocessor, and having a portion disposed at the lower face.

Preferably, the case body further has a strengthening eaves extending from a top of the wall inward to the case body.

The above objects and advantages of the present invention will become more readily apparent to those ordinarily skilled in the art after reviewing the following detailed descriptions and accompanying drawings, in which:

DETAILED DESCRIPTION OF THE PREFERRED EMBODIMENTS

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Figure 1:
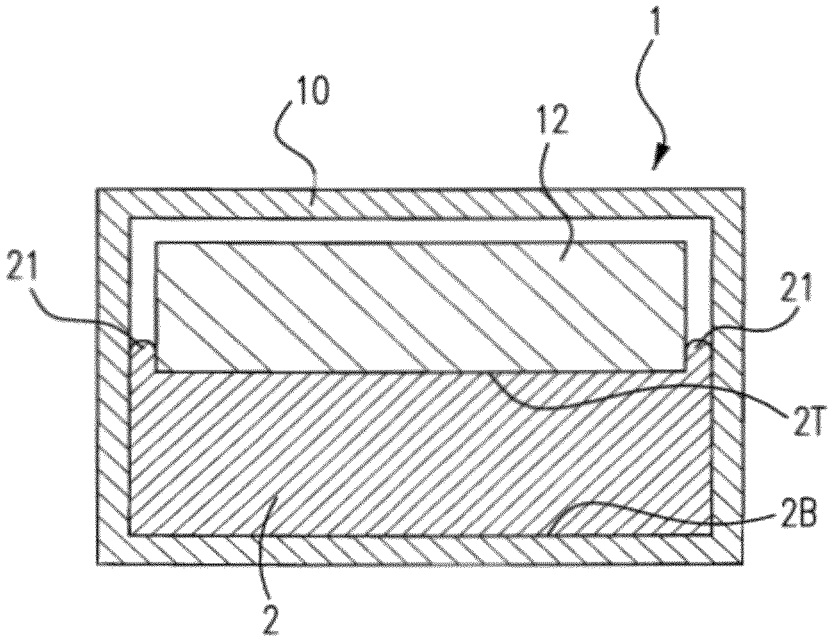
Fig. 1(Prior Art)
FIG. 1 shows a conventional USB plug in use.
Figure 2:
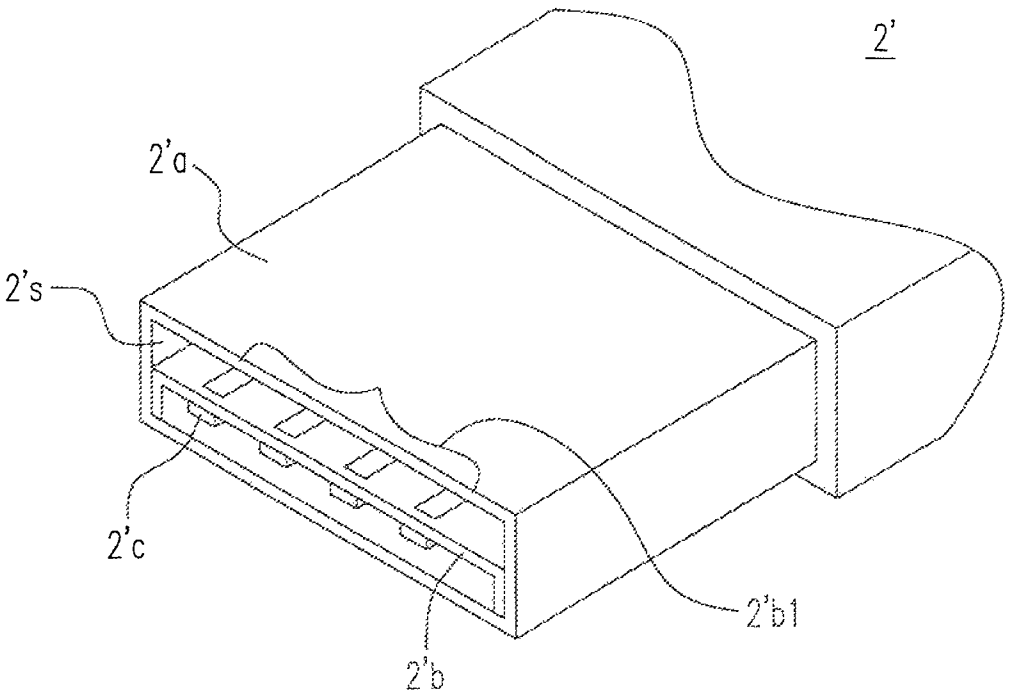
Fig. 2(Prior Art)
FIG. 2 shows another conventional USB plug.
Figure 3:
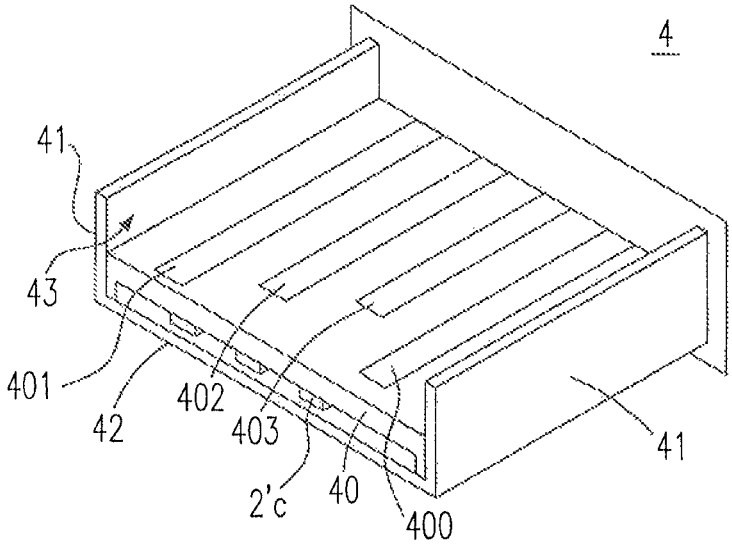
FIG. 3 shows a USB wireless connection port according to a preferred embodiment of the present invention.

Please refer to FIG. 3, which shows a USB wireless connection port 4 according to a preferred embodiment of the present invention. The USB wireless connection port 4 includes a pair of lateral boards 41 and a lower board 42. The lateral boards 41 and the lower board 42 form a structure which is like a metal frame. That is, the metal frame is formed by the lateral boards 41 and the lower board 42. Besides, the metal frame formed by the lateral boards 41 and the lower board 42 is like a case body without a cover. A circuit board 40 is disposed in the metal frame. A power terminal 400, a ground terminal 401, a signal input terminal 402 and a signal output terminal 403 are disposed at the upper face of the circuit board 40. A plurality of electronic elements 2'*c* are disposed at the lower face of the circuit board 40. Moreover, all terminals 400-403 are electrically connected to a wireless module (not shown) and one of a microprocessor (not shown) and a microcomputer (not shown). Furthermore, a gap 43 is formed in the direction parallel to the circuit board 40. As shown in FIG. 3, the upper portion of the metal frame is hollow. The position of the circuit board 40 is distant from the upper portion of the metal frame, and all terminals 400-403 face the hollow area and are directly exposed. Hence, the conditions of all terminals 400-403 can be easily observed during the quality control process. Accordingly, such issue as whether the terminals are rusty, slanting, lumpy or defective can be clear at a glance. That is, even if the USB wireless connection port 4 is well assembled, the quality control process therefor still can be performed. Hence, the present invention greatly contributes to the enhancement of the yield.

Figure 4:
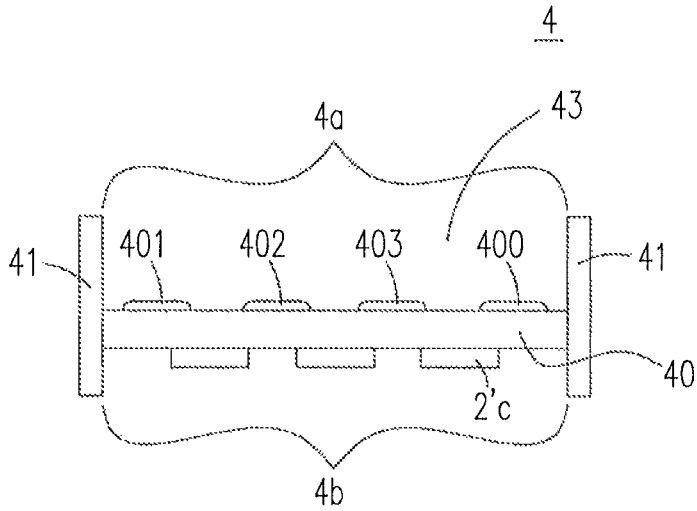
FIG. 4 shows a USB wireless connection port according to another preferred embodiment of the present invention.

FIG. 4 shows a USB wireless connection port according to another preferred embodiment of the present invention. The USB wireless connection port 4 includes a pair of metal lateral boards 41. A first opening 4*a* and a second opening 4*b* are formed between the metal lateral boards 41. A circuit board 40 is disposed at the second opening 4*b*. A plurality of terminals 400-403 are disposed at a face of the circuit board 40 and face the first opening 4*a*. A wireless module (not shown) is electrically connected to the terminals 400-403. At least a portion or all of an electronic element 2'*c* is disposed at another face of the circuit board 40. The electronic element 2'*c* is a microcomputer chip or a microprocessor. The embodiment of FIG. 4 differs from that of FIG. 3 in that it does not have the lower board 42 of FIG. 3, thereby forming the second opening 4*b*. That is, the lower side of the USB wireless connection port 4 is also hollow. This facilitates the inspection during the quality control process.

Figure 5:
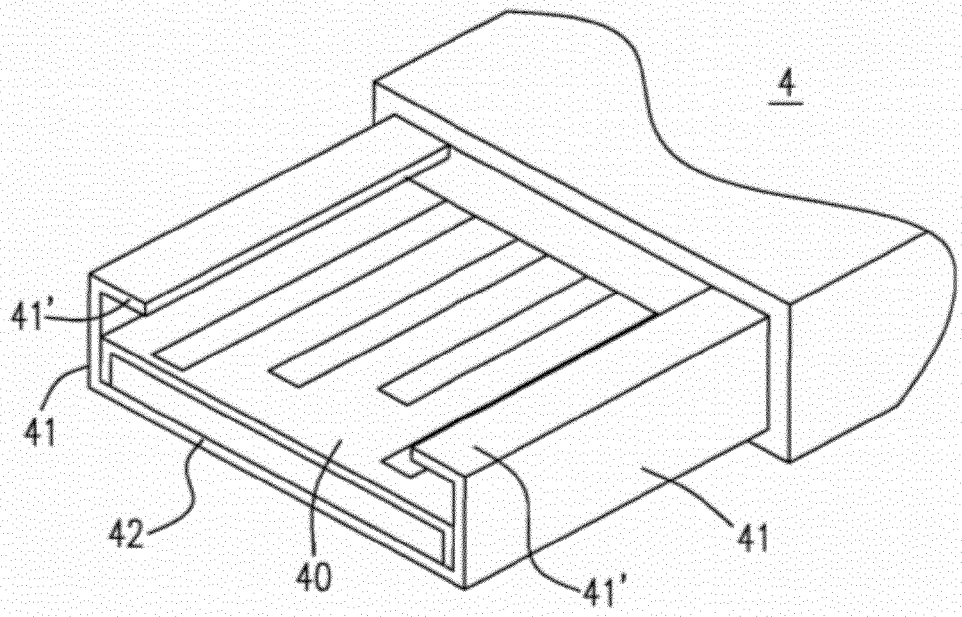
FIG. 5 shows a USB wireless connection port according to a further preferred embodiment of the present invention.

Please refer to FIG. 5, which shows a USB wireless connection port according to a further preferred embodiment of the present invention. The USB wireless connection port 4 of FIG. 5 is similar to that of FIG. 3, wherein two lateral boards 41 and a lower board 42 are combined to form a metal frame. The upper side of the metal frame is hollow, and a circuit board 40 is disposed near the lower board 42. The USB wireless connection port 4 of FIG. 5 differs from that of FIG. 3 in that the tops of the two lateral boards 41 respective extend inward to form two strengthening eaves 41'. This prevents the two lateral boards 41 from bending and avoids sharp edges of the two lateral boards 41. Besides, the two strengthening eaves 41' of the two lateral boards 41 can also be referred to as an upper board of the metal frame. That is, for all terminals 400-403 (please refer to FIG. 3), the upper board is hollow.

Figure 6:
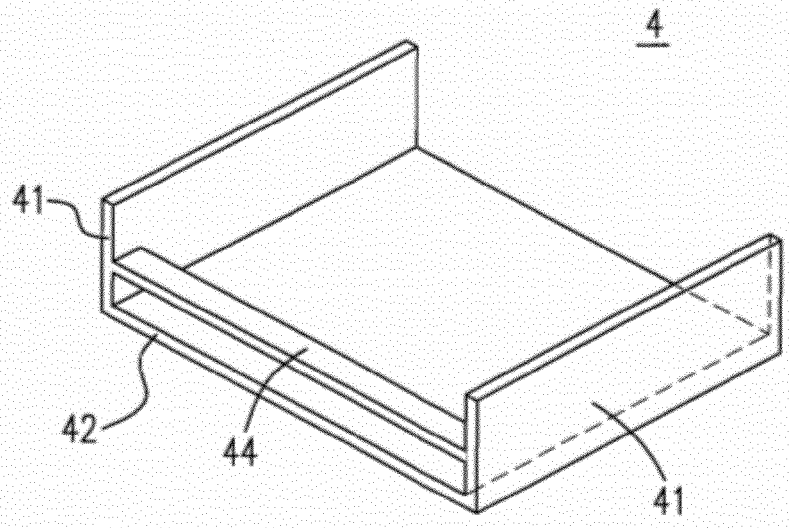
FIG. 6 shows a USB wireless connection port according to further another preferred embodiment of the present invention.

Please refer to FIG. 6, which shows a USB wireless connection port according to further another preferred embodiment of the present invention. As shown in FIG. 6, a beam 44 is disposed between the two lateral boards 41 of the USB wireless connection port 4 to control the distance therebetween. The beam 44 can also be disposed between the two lateral boards 41 of the USB wireless connection port 4 of FIG. 3 or FIG. 4.

Figure 7:
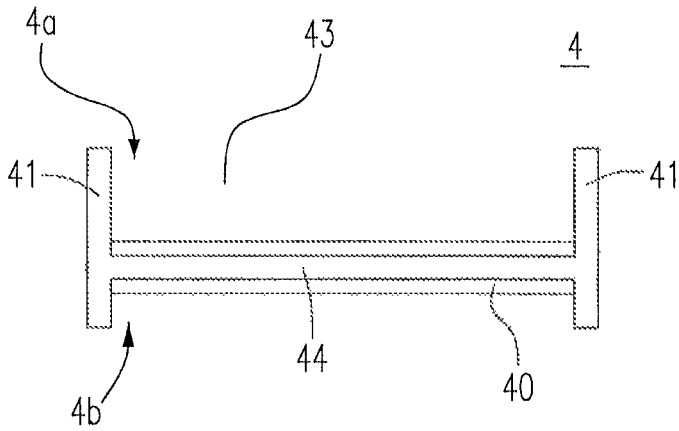
FIG. 7 shows a USB wireless connection port according to further another preferred embodiment of the present invention.

Please refer to FIG. 7, which shows a USB wireless connection port according to further another preferred embodiment of the present invention, wherein the beam 44 of FIG. 6 is disposed between the two lateral boards 41 of the USB wireless connection port 4 of FIG. 4. FIG. 7 is a front view of the USB wireless connection port 4, i.e. facing the gap 43 thereof. Since the circuit board 40 is near the second opening 4*b* and distant from the first opening 4*a*, in order not to hinder the insertion, the beam 44 and the circuit board 40 are disposed at the same height. In any case, the height of the beam 44 will not go beyond that of the upper face or the lower face of the circuit board 40. Besides, it is ensured that the distance between the two lateral boards 41 can be maintained by the beam 44.

Figure 8:
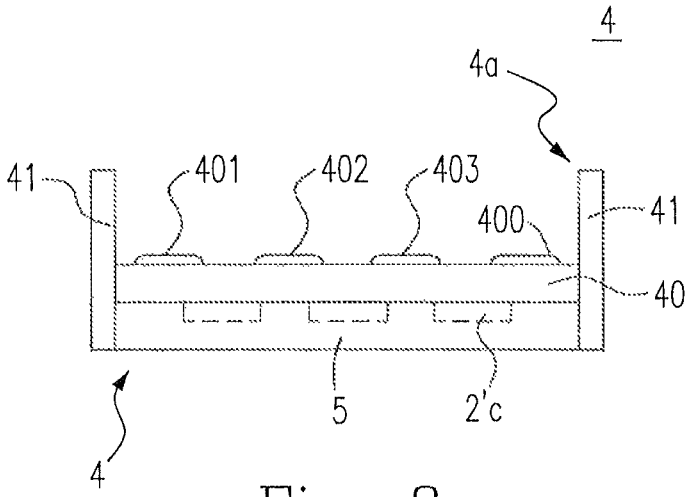
FIG. 8 shows a USB wireless connection port according to further another preferred embodiment of the present invention.

FIG. 8 shows a USB wireless connection port according to further another preferred embodiment of the present invention. FIG. 8 is a front view of the USB wireless connection port 4. A circuit board 40 is disposed between two lateral boards 41. A plurality of terminals 400-403 are disposed at the upper face of the circuit board 40, and a plurality of electronic elements 2'*c* are disposed at the lower face thereof. A first opening 4*a* is formed between the tops of the two lateral boards 41, and the circuit board 40 is positioned at the second opening 4*b* (please refer to FIG. 4). When all electronic elements 2'*c* are well inspected, the second opening 4*b* is filled with the resin. This prevents the electronic elements 2'*c* from damage due to collision with external objects.

The terminals of the USB wireless connection port 4 of the present invention not only is electrically connected to a wireless module, but also can be electrically connected to a microcomputer or a microprocessor. At least a portion of the electronic elements can be disposed at the lower face of the circuit board 40 to shorten the overall length of the USB wireless connection port 4. Especially when the present invention is applied in the notebook computer, if the portion of the USB device protruding from the USB socket of the notebook computer is shorter, the probability of colliding with and damaging the USB device is lower.

The lateral boards of the USB wireless connection port of the present invention are made of metal, which is more resistive to attrition than the nonmetal material. Therefore, the USB wireless connection port of the present invention is not easy to be worn out after many times of insertion and pull. Furthermore, the height of the lateral boards of the present invention totally conforms to the current USB2.0 standard. Moreover, the circuit board of the present invention is disposed near a side of the USB wireless connection port according to the standard. As shown in FIGS. 3-8, the circuit board is disposed near the lower side of the USB wireless connection port. Therefore, the foolproof effect of the USB wireless connection port of the present invention is completely the same as that of the conventional USB connector. Furthermore, the present invention can also be applied in the mini-USB connection port. For the mini-USB connection port, the hollow design of the present invention can enhance the performance of the quality control, since the size of the mini-USB connection port is smaller and more attention should be paid during the quality control process.

Based on the above, the USB wireless connection port of the present invention is made by hollowing out the upper side of the conventional USB connector, so that whether the size tolerance is erroneous, the terminals are rusty, the conditions of the surfaces of the terminals are fine, or the positions of the terminals are correct can be observed during the quality control. Another advantage of the present invention is that when the consumer purchases the product and takes off the seal, he can see the conditions of the terminals of the product immediately so that he can return the product at once if it is defective. If the terminals are rusty or the surfaces thereof are lumpy, the USB socket of the consumer may be damaged. In this regard, the hollow design of the present invention is convenient for the consumer to observe the terminals of the product, and thus the above-mentioned issue can be avoided. For the manufacturer, it does not have to pay for the damage of the USB socket of the consumer resulting from the defective terminals. In addition, the materials can be saved and the cost can be reduced. Moreover, the present invention is also convenient for the consumer to identify the face of the USB wireless connection port. Accordingly, the consumer would not insert the USB wireless connection port into the USB socket upside down to cause the unnecessary collision therebetween. In sum, through the present invention, the quality control can still be performed for the internal electronic elements and terminals after the USB wireless connection port is well assembled, which greatly contributes to the field of the connector.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A USB wireless connection port for a keyboard, a mouse and a presenter, comprising:

a plug body, including:

a pair of lateral boards made of metal;

an upper board; and a lower board made of metal;

a circuit board disposed inside the plug body and having an upper face and a lower face, wherein the USB wireless connection port has a distance between the circuit board and the upper board greater than that between the circuit board and the lower board;

a power terminal disposed at the upper face of the circuit board, wherein the upper board has a hollow area exposing the power terminal;

a ground terminal disposed at the upper face of the circuit board, wherein the hollow area exposes the ground terminal;

a signal output terminal disposed at the upper face of the circuit board, wherein the hollow area exposes the signal output terminal;

a signal input terminal disposed at the upper face of the circuit board, wherein the hollow area exposes the signal input terminal; and an electronic element disposed at the lower face of the circuit board and including a wireless module for receiving and sending a wireless signal.

2. The USB wireless connection port as claimed in claim 1, further comprising a microcomputer chip electrically connected to the power terminal, the ground terminal, the signal output terminal and the signal input terminal.

3. The USB wireless connection port as claimed in claim 1, further comprising a microprocessor electrically connected to the power terminal, the ground terminal, the signal output terminal and the signal input terminal.

4. The USB wireless connection port as claimed in claim 1, wherein the USB wireless connection port is a mini-USB connection port.

5. A USB wireless connection port for a keyboard, a mouse and a presenter, comprising:

a pair of metal lateral boards, forming a first opening and a second opening therebetween;

a circuit board disposed at the second opening, and having a first face and a second face;

a plurality of terminals disposed at the first face of the circuit board and facing the first opening;

a wireless module electrically connected to the terminals; and an electronic element having at least a portion disposed at the second face of the circuit board, and being one of a microcomputer and a microprocessor.

6. The USB wireless connection port as claimed in claim 5, further comprising a beam disposed between the metal lateral boards.

7. The USB wireless connection port as claimed in claim 5, wherein the terminals comprise a power terminal, a ground terminal, a signal output terminal and a signal input terminal.

8. The USB wireless connection port as claimed in claim 5, wherein the second opening is filled with a resin for covering the at least a portion of the electronic element.

9. A USB wireless connection port for a keyboard, a mouse and a presenter, comprising:

a metal frame;

a circuit board disposed inside the metal frame and having an upper face and a lower face, wherein the upper face has a plurality of terminals disposed thereon and the lower face has an electronic element disposed thereon; and a wireless module electrically connected to the terminals, wherein the metal frame has a first hollow area above the upper surface of the circuit board, and the electronic element is selected from a group consisting of a microcomputer chip, a microprocessor and the wireless module.

10. The USB wireless connection port as claimed in claim 9, wherein the metal frame has a second hollow area below the lower face.

11. The USB wireless connection port as claimed in claim 9, further comprising a protection layer covering the electronic element.

* * * * *